US006162138A

United States Patent [19]

McKee

[11] Patent Number: 6,162,138

[45] Date of Patent: Dec. 19, 2000

[54] ATTACHMENTS PRESENTING ROTATION AID SURFACES FOR TENNIS RACQUET AND METHOD OF ATTACHING THE SAME

[76] Inventor: Roger W. McKee, 13332 SW. Vermeer Dr., Lake Oswego, Oreg. 97035

[21] Appl. No.: 09/192,868

[22] Filed: Nov. 16, 1998

[51] Int. Cl.[7] ..... A63B 49/00

[52] U.S. Cl. ..... 473/553

[58] Field of Search ..... 473/524, 553, 473/546

[56] References Cited

U.S. PATENT DOCUMENTS

| | | | |
|---|---|---|---|
| 5,316,295 | 5/1994 | Costanzo | 473/546 X |
| 5,879,249 | 3/1999 | Fox-Gurcay | 473/553 |

FOREIGN PATENT DOCUMENTS

| | | | |
|---|---|---|---|
| 275805 | 7/1988 | European Pat. Off. | 473/FOR 171 |
| 2684013 | 5/1993 | France | 473/FOR 171 |
| 94/00203 | 1/1994 | WIPO | 473/FOR 171 |

*Primary Examiner*—Raleigh W. Chiu

*Attorney, Agent, or Firm*—Marger Johnson & McCollom, P.C.

[57] ABSTRACT

A tennis racquet is provided that has rotation aid attachments attached to the frame at the throat. The attachments include adhesive-backed textured strips attached to the outside surfaces of the arms, or two straps wrapped around the arms of the frame. The attachments present good traction to the finger tips of the off hand when finding the tennis ready position or making a grip change. The invention further provides a method of retrofitting a tennis racquet with the attachments.

6 Claims, 2 Drawing Sheets

ATTACHMENTS PRESENTING ROTATION AID SURFACES FOR TENNIS RACQUET AND METHOD OF ATTACHING THE SAME

BACKGROUND OF THE INVENTION

1. Field of the Invention

The present invention is related to the field of tennis racquets, and more specifically to rotation aid means for assisting a player to adjust quickly and reliably the angular orientation of a tennis racquet within the playing hand.

2. Description of the Related Art

When playing tennis, a player sometimes needs to make a quick grip change between shots. Players make such grip changes by first grasping the throat of the racquet with the finger tips of the off hand, which is also called the non dominant hand. If that hand is sweaty or cold, or if the racquet surface is slippery, the throat can slip, which can result in a less accurate grip change.

BRIEF SUMMARY OF THE INVENTION

The present invention overcomes the problem of the prior art.

Generally, the present invention provides an improved tennis racquet that includes a handle, a head and a throat made of one or two arms. When two arms, each arm defines an inside surface that faces the other arm and an outside surface opposite the inside surface.

At least a portion of the outside surface of at least one of the arms is non skid. This is accomplished by including a rotation aid means that renders the outside surface non skid. The rotation aid means can be a strap wrapped and secured around the arm.

The preferred rotation aid means is a pad with a textured contact surface attached to the outside surface. Attachment is with adhesive preferably provided in the back of the pad.

The rotation aid means assists in finding the tennis ready position and in making grip changes easier. A particularly advantageous feature of this invention is that existing tennis racquets can be retrofitted economically to improve play, according to a method of the invention.

These and other features and advantages of the present invention will become apparent and more appreciated after consideration of the Drawing(s) and Detailed Description of the Preferred Embodiment(s) of the invention.

DETAILED DESCRIPTION OF THE PREFERRED EMBODIMENT(S) OF THE INVENTION

Figure 1:
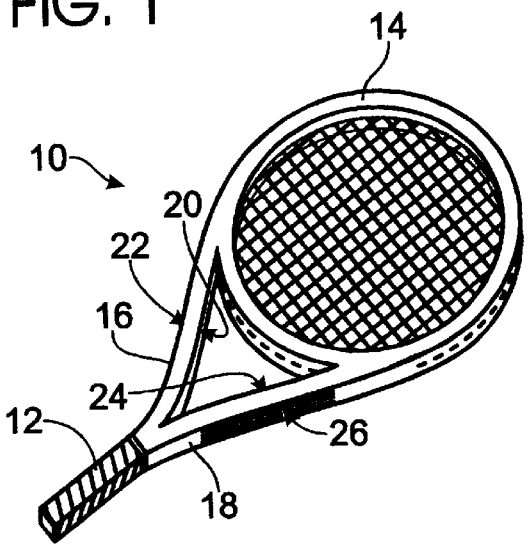
FIG. 1 is a perspective view of a tennis racquet according to a general embodiment of the invention.

As has been mentioned, the present invention provides a tennis racquet that includes rotation aid means. A general embodiment of the invention is now described with reference to FIG. 1.

A tennis racquet 10 comprises a handle 12 for a player to grip the racquet and a head 14 for hitting the tennis ball. The handle and the frame are connected with a portion of the frame known as the throat.

The throat is typically made of two arms 16, 18. Each arm has a proximate end and a distal end opposite each other. The proximate ends are coupled with the handle and the distal ends are coupled with the head. Alternately, briefly considering FIG. 4, the throat of racquet 11 is a single arm 17. The same can be applied to racquet 11 as to racquet 10 of FIG. 1.

Returning to FIG. 1, each arm defines an inside surface (that faces the other arm), and an outside surface that is opposite the inside surface. Specifically, arm 16 defines an inside surface 20 and an outside surface 22. Arm 18 defines an inside surface 24 and an outside surface 26. Analogously, arm 17 of the monoframe racquet of FIG. 4 defines two side surfaces 23, 27 that are perpendicular to the plane of head 14.

Returning to FIG. 1, at least a portion of at least one of outside surfaces 22, 26 is adapted to be non skid. The non skid surface presents traction to the off hand during the grip change. It helps make the rotation of the racquet within the grip of the playing hand more accurate.

The surface is adapted to be non skid in a number of ways. One such way is to include grooves on the frame. The groves preferably are aligned with the direction of the arm, as seen in surface 26 of FIG. 1. Making the grooves on the outside surfaces generally results in a portion of the outside surfaces being textured differently than the inside surfaces.

Figure 2:
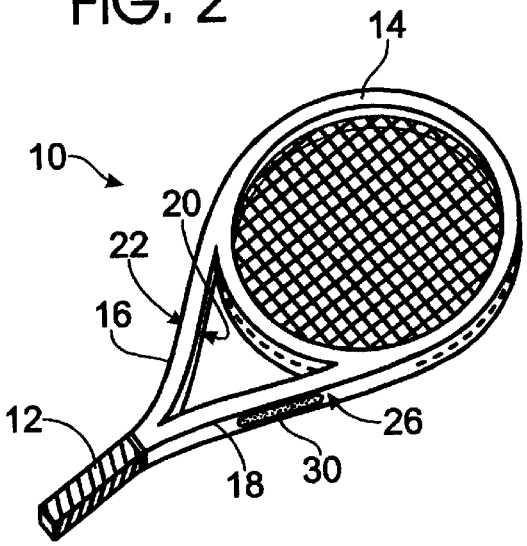
FIG. 2 is a perspective view of a tennis racquet according to the preferred embodiment of the invention.
Figure 3:
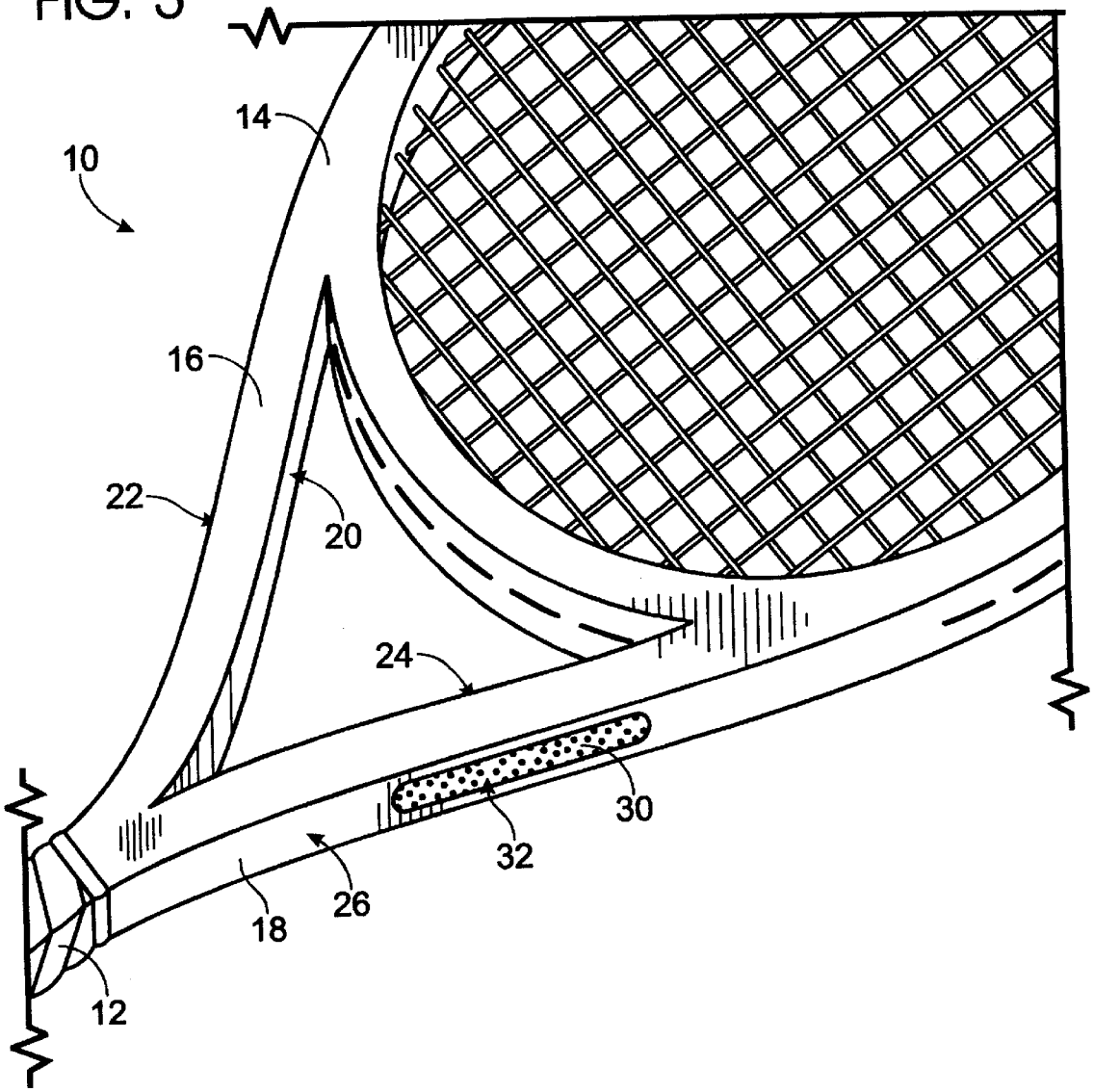
FIG. 3 is a view amplifying a detail of FIG. 2.
Figure 4:
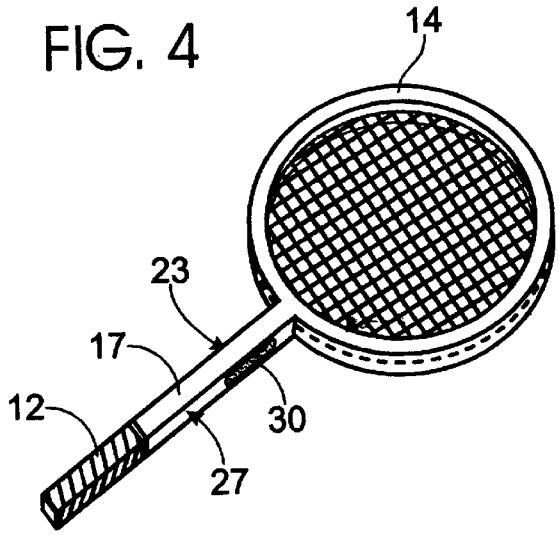
FIG. 4 is a perspective view of a monoframe tennis racquet according to the preferred embodiment of the invention.

The preferred embodiment of the invention is now described with reference to FIGS. 2, 3 and 4. For racquet 10 of FIGS. 2 and 3, the preferred embodiment comprises a rotation aid means 30, attached to outside surface 26. Preferably a similar means 30 is also attached to the other outside surface 22. For racquet 11 of FIG. 4, the preferred embodiment comprises a rotation aid means 30, attached to side surface 27. Preferably a similar means 30 is also attached to the other side surface 23.

In both cases, means 30 preferably presents an exposed contact surface 32 that is non skid. The fingers of the player touch the contact surface. The contact surface is made non skid by being textured, such as made from rubber or sand paper like material. The embodiment is preferred because it allows better touch/feel as the tennis player uses the off hand to help find the tennis ready position and make grip changes.

The preferred rotation aid means 30 is a pad that has an adhesive backing layer for easy attachment. The pad, preferably called a touch pad, is 2"–3" long, and ½"–¾" wide, depending on the size of the racquet frame. It is preferably made as wide as the frame permits, without overhanging the edge of outside surface 26. It is about 5 mm or less thick, so that the aerodynamic performance of the racquet is not affected.

Figure 5:
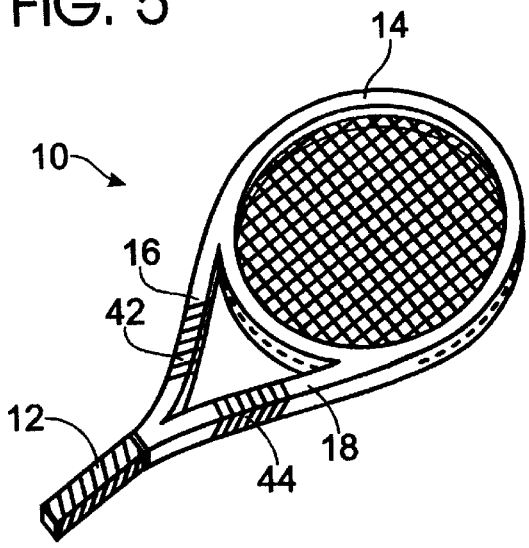
FIG. 5 is a perspective view of a tennis racquet according to the another embodiment of the invention.

Another embodiment is now described with reference to FIG. 5. Straps 42, 44 are wrapped and secured around arms 16, 18 respectively. The straps are advantageously made from the same material as the strap that is wrapped and secured around handle 12. They provide traction, but are heavier than touch pads 30 of FIG. 3. A single strap could be used for a monoframe racquet.

In all of the above cases, the rotation aid means is located preferably at the portion of the throat that is the optimum to grasp for a tennis ready position and for a grip change. This way the rotation aid means assists the player in locating the optimum portion.

The improved tennis racket of the present invention can be manufactured incorporating the rotation aid means. Alternately a tennis racket can be retrofitted with rotation aid means as described below.

A method according to the present invention is for retroffitting a prior art tennis racquet with the rotation aid means of the invention. First, the optimum grasping portion of the racquet is identified. That portion is also preferably marked, e.g. by a pencil or a marker. Then the tennis racquet is supported such that at least one of the arms is exposed. This is performed as is known in the art, eg. by clamps, etc.

According to another step, a rotation aid means is attached to the exposed arm, and preferably at the identified optimum position. According to one embodiment, attaching can be by wrapping a strap around the arm. The strap is then secured. If done on racquet 10, the retroffitted racquet appears as seen in FIG. 5.

Figure 6:
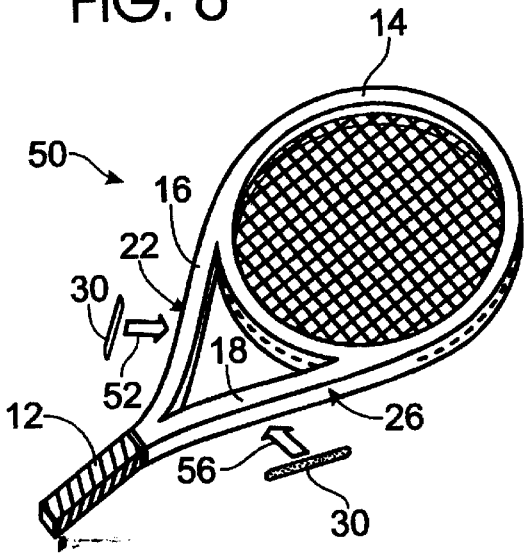
FIG. 6 shows the attaching step of a retrofitting method of the present invention.

According to another embodiment seen in FIG. 6, a prior art racquet 50 is retrofitted by applying touch pads 30 to outside surfaces 22, 26 according to arrows 52, 56, respectively. The touch pads preferably have adhesive backing, and are applied by activating the adhesive backing, such as by removing a protective cover sheet from it. Preferably attaching is such that the touch pads do not cover the inside surface.

A person skilled in the art will be able to practice the present invention in view of the present description. In the present description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention. Again, one skilled in the art will appreciate that it is possible to make various modifications, additions and substitutions to the present description without departing from the scope and spirit of the invention as claimed in the accompanying claims.

The invention claimed is:

1. A tennis racquet comprising:

a handle for gripping the racquet;

a head for hitting a tennis ball;

two arms, each arm having a proximate end and a distal end opposite each other, the proximate ends coupled with the handle, the distal ends coupled with the head, each arm defining an outside surface that faces away from the other arm;

rotation aid means attached to the outside surface of at least one of the arms; and wherein the rotation aid means is a strap wrapped around the arm.

2. A tennis racquet comprising:

a handle for gripping the racquet;

a head for hitting a tennis ball;

an arm having a proximate end and a distal end opposite each other, the proximate end coupled with the handle, the distal end coupled with the head;

rotation aid means attached to the arm; and wherein the rotation aid means is a strap wrapped around the arm.

3. A method of retrofitting a tennis racquet, the tennis racquet comprising a handle for gripping the racquet, a head for hitting a tennis ball, and two arms, each arm having a proximate end and a distal end opposite each other, the proximate ends coupled with the handle, the distal ends coupled with the head, the method comprising the steps of:

supporting the tennis racquet such that at least one of the arms is exposed;

identifying a portion of the exposed arm that is optimum for grasping for a grip change; and attaching a rotation aid means to the identified portion of the exposed arm.

4. The method of claim 3 further comprising the step of marking the identified optimum portion.

5. A method of retrofitting a tennis racquet, the tennis racquet comprising a handle for gripping the racquet, a head for hitting a tennis ball, and two arms, each arm having a proximate end and a distal end opposite each other, the proximate ends coupled with the handle, the distal ends coupled with the head, the method comprising the steps of:

supporting the tennis racquet such that at least one of the arms is exposed; and attaching a rotation aid means to the exposed arm, wherein the attaching step is by wrapping a strap around the exposed arm.

6. A method of retrofitting a tennis racquet, the tennis racquet comprising a handle for gripping the racquet, a head for hitting a tennis ball, and two arms, each arm having a proximate end and a distal end opposite each other, the proximate ends coupled with the handle, the distal ends coupled with the head, each arm defining an inside surface that faces the other arm and an outside surface opposite the inside surface, the method comprising the steps of:

supporting the tennis racquet such that at least one of the arms is exposed; and attaching a rotation aid means to the exposed arm such that the rotation aid means does not cover the inside surface.

* * * * *